United States Patent [19]

Roll

[11] Patent Number: 4,888,668

[45] Date of Patent: Dec. 19, 1989

[54] MIRROR LIGHT UNIT

[75] Inventor: Karl-Fritz Roll, Chieming, Fed. Rep. of Germany

[73] Assignee: Siemens Aktiengesellschaft, Berlin and Munich, Fed. Rep. of Germany

[21] Appl. No.: 244,163

[22] Filed: Sep. 14, 1988

[30] Foreign Application Priority Data

Sep. 28, 1987 [DE] Fed. Rep. of Germany ..... 3732610

[51] Int. Cl.[4] ..... F21V 7/00

[52] U.S. Cl. ..... 362/291; 362/347; 362/217; 362/342

[58] Field of Search ..... 362/217, 290, 291, 342, 362/325, 347, 346, 296, 297

[56] References Cited

U.S. PATENT DOCUMENTS

| | | | |
|---|---|---|---|
| 3,591,798 | 11/1968 | Florence | 362/225 |
| 4,407,011 | 9/1983 | Lahm | 362/290 |
| 4,429,354 | 1/1984 | Garnett | 362/347 |
| 4,494,175 | 1/1985 | Gawad et al. | 362/347 |
| 4,539,628 | 9/1985 | Bartenbach | 362/217 |

FOREIGN PATENT DOCUMENTS

| | | |
|---|---|---|
| 0061526 | 10/1982 | European Pat. Off. . |
| 3112210 | 10/1982 | Fed. Rep. of Germany . |
| 3215026 | 3/1984 | Fed. Rep. of Germany . |
| 8702921 | 7/1987 | Fed. Rep. of Germany . |
| 2542848 | 9/1984 | France . |
| 814354 | 6/1959 | United Kingdom . |

*Primary Examiner*—Ira S. Lazarus
*Assistant Examiner*—D. M. Cox
*Attorney, Agent, or Firm*—Hill, Van Santen, Steadman & Simpson

[57] ABSTRACT

Mirror lighting unit. To satisfy special demands on the light density distribution, such as are required, for example, by video workstations, use is made of mirror lighting units, which, in addition to longitudinal mirrors provided on both sides of a lamp, have louvre vanes of double-parabola-shaped cross-section arranged transverse to the extent of the lamp on the side where the light is emitted, and which are aligned relative to the lamp with the base side of their cross-section. In order to keep as low as possible the emission losses occasioned by such louvre vanes, the louvre vanes are provided on their base side with reflecting covers, which can, however, cause the image of the lamp which they reflect to emerge via further reflections on the longitudinal mirrors at an angle of emission which destroys the screening effect required of such lighting units. It is possible to prevent this by giving the base-side cover of the louvre vanes a special hood-shaped form, but the expense occasioned thereby is substantial. A special embodiment of such a louvre vane is provided, which can be formed from a single sheet-metal part, together with the hood-shaped cover satisfying the emission condition for the mirror lighting unit.

6 Claims, 3 Drawing Sheets

MIRROR LIGHT UNIT

BACKGROUND OF THE INVENTION

The present invention relates to a mirror lighting unit for a rod-shaped lamp, especially a fluorescent tube, having longitudinal mirrors extending on both sides parallel to the lamp. The unit also has louvre vanes arranged transverse thereto underneath the lamp and adjusted relative to the lamp with the base of their double-parabola-shaped cross-section. All along their length the louvre vanes have a hood-shaped cover with reflecting surfaces on the base side of their cross-section. With this the line of intersection of the cover with a plane extending perpendicular to the longitudinal axis of the lamp has a concave curvature symmetrical in relation to the longitudinal axis of the lamp.

A mirror lighting unit of this type is disclosed, for example, in the German reference DE 3,112,210 C2. Here, the hood-shaped cover consists of a silvered injection-moulded part, which is mounted with its base side onto the louvre vane and, starting from a central zone, extends along the louvre vane, increasing in height towards the vane rim. With such a hood-shaped cover it is certainly possible to avoid undesirable reflections at this cover, but the expense required for this is substantial.

Reflecting covers of louvre vanes are known, for example from the British reference GB Patent 814,354, which are also mounted at the base sides on the louvre vanes, and can have a plane, triangular or arch-shaped cross-section. For mirror lighting units requiring a luminous density less than or equal to 200cd/m$^2$, the so-called "condition", for angles of emission$\gamma$ greater than or equal to 50°, it is not possible to guarantee this demand with certainty in every case. In this case, the base-side reflecting cover of the louvre vanes cannot prevent the image of the lamp emerging from the unit by virtue of multiple reflections at an angle of $\gamma$ greater than 50°, that is from causing the lamp to flash. In this connection, sections of the cover extending along the louvre vanes are especially critical in the rim zone of the louvre vanes, whereas in the central zone a plane cover is often required.

In order to eliminate the effect of these rim zones it is therefore necessary, as is the case for the mirror lighting unit according to the first-named reference, to raise the base-side reflecting cover in the rim zones of the louvre vane above the height of the latter's base.

SUMMARY OF THE INVENTION

It is an object of the present invention to provide, for a mirror lighting unit of the type described above, an improved design for a louvre vane having a reflecting, hood-shaped cover. Light losses caused by the louvre vanes thus are as low as possible. It also satisfies the requisite luminous density distribution for office workstation lamps, and especially does not destroy the screening effect required here for an angle of emission of $\gamma$ greater than or equal to 50°.

According to the present invention, this object is achieved by a mirror lighting unit for a rod-shaped lamp, especially a fluorescent tube, having longitudinal mirrors extending on both sides parallel to the lamp, and louvre vanes arranged transverse thereto underneath the lamp and adjusted relative to the lamp with a base of their double-parabola-shaped cross section. All along their length the louvre vanes have a hood-shaped cover with reflecting surfaces on the base side of their cross-section. With this line of intersection of the cover with a plane extending perpendicular to the longitudinal axis of the lamp it has a concave curvature symmetrical in relation to the longitudinal axis of the lamp. For simple manufacture of the louvre vanes, the unit includes their hood-shaped cover, from in each case one shapeable sheet-metal part the concave curvature of the line of intersection of the hood-shaped cover being approximated with a flat central part. The flat central part merges on both sides into a four-sided pyramid-shaped hood open towards the adjacent longitudinal mirror, and an angle of pitch ($\epsilon$) of upper sides of the pyramid-shaped hoods, which continue the flat central part on opposite sides, is dimensioned so as to approximate the resultant course of the line of intersection of the surfaces to a parabola.

The present invention is based on the realization that the curved contour of the hood-shaped cover, which rises along the length of the louvre vane in order to avoid undesirable reflections, need not be continuously constructed, but can also have a flat central part, which is supplemented on both sides to form the desired hood-shaped cover by means of a pyramid-shaped hood, which extends in each case as far as the vane rim, and has in each case flat side surfaces.

By means of this shaping, it is achieved in an exceptionally advantageous way that the louvre vane, together with the hood-shaped cover can be shaped in a simple and cost-saving manner from a single sheet-metal part, so that it is possible to dispense with a special, base-side attachment in the form of a silvered injection-moulded part.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several figures of which like reference numerals identify like elements, and in which:

DESCRIPTION OF THE PREFERRED EMBODIMENTS

Figure 1:
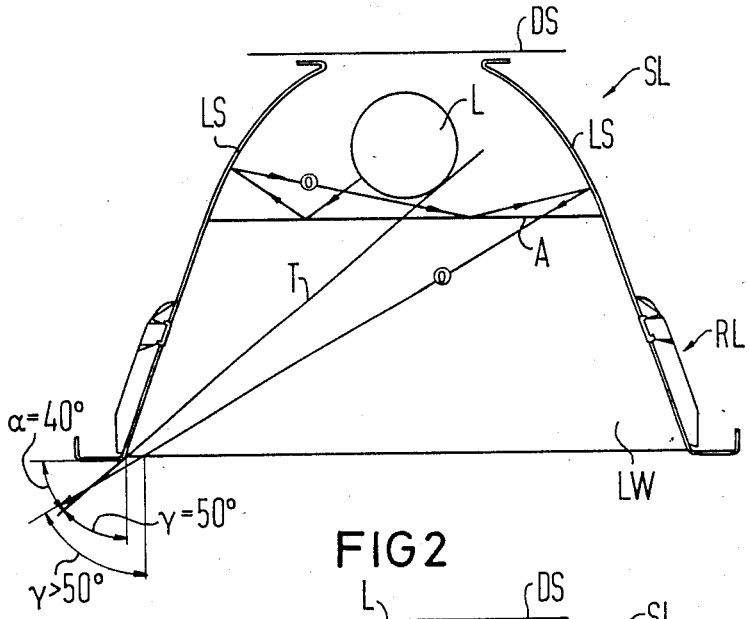
FIG. 1 is a cross-sectional view of a mirror lighting unit with louvre vanes, having a plane, reflective cover at the base side.

The mirror lighting unit SL according to FIG. 1 shows two longitudinal mirrors LS with parabolic contour, between which the rod-shaped lamp L, for example, a fluorescent tube, is arranged symmetrically in the upper half. Above the lamp L a plane roof mirror Ds is provided, which, for example, can also be the interior of the unit's housing. Transverse to the longitudinal mirrors LS, and anchored at their ends, there are arranged louvre vanes RL which have a double-parabola-shaped cuneiform cross-section, and are adjusted relative to the lamp at the base side. The louvre vanes RL are provided at the base side with a plane, reflecting cover A, which can extend, for example, from the rim of the vane walls LW, being bent into the horizontal plane at the base side.

The dimensions of the mirror lighting unit SL are chosen in such a way that the tangent T just touching the lower rim of a longitudinal mirror LS subtends a screening angle $\alpha=40°$ to the lamp L. In this way, it is no longer possible to perceive a direct image of the lamp L at an angle of emission $\gamma$ greater than 50°. Given an appropriately designed contour of the longitudinal mirror LS and of the louvre vanes RL, the zone $\gamma$ greater than 50°represents the screening zone of the lamp, in which, to the extent that the BAP condition is to be fulfilled here, the luminous density is less than or equal to 200cd/m$^2$.

Drawn in on the representation of the lamp according to FIG. 1 is a critical light beam 0, which illustrates that the plane, base-side cover A of the louvre vanes RL outside the central zone provides for the image of the lamp L reflected at the plane, base-side cover of the louvre vanes RL to emerge at an angle $\gamma$ greater than 50° from the light opening of the unit SL, as a result of multiple reflection in conjunction with the longitudinal mirrors LS This destroys the screening desired in the zone $\gamma$ greater than 50°.

Figure 2:
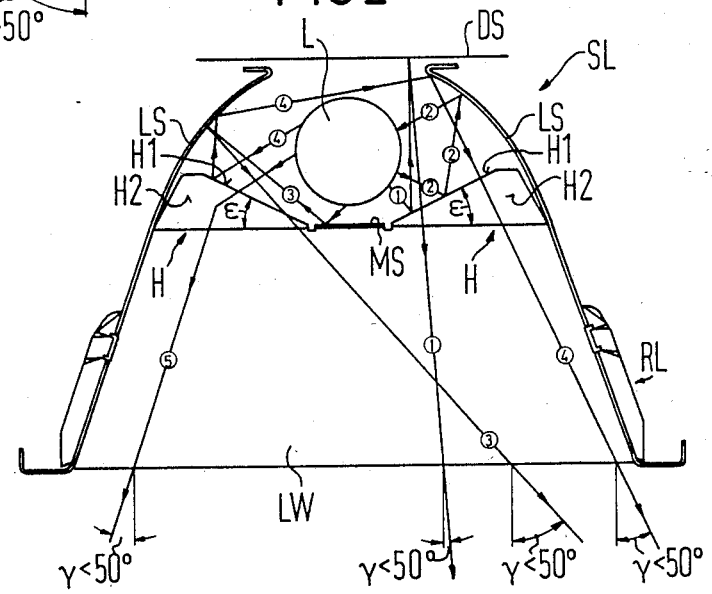
FIG. 2 is a cross-sectional view of a modified mirror lighting unit according to FIG. 1 with a louvre vane which has a hood-shaped cover and is manufactured from a single sheet-metal part.

Instead of the plane, base-side cover of the louvre vanes RL depicted in FIG. 1, the unit SL according to FIG. 2 has a hood-shaped cover A in the form of a flat central part MS, to which on both sides is joined a four-sided pyramid-shaped hood H which is open towards the adjacent longitudinal mirror LS. As represented in FIG. 2, the line of intersection of the contour of this hood-shaped cover with a plane perpendicular to the lamp axis represents an approximation to a concave curvature in the form of a parabola, which is consequently determined by the angle of pitch $\epsilon$ of the upper sides H1 of the hood H which continue the plane central part MS on opposite sides. The slant sides H2 and H3 of the pyramid shaped hoods H, of which only the slant side H2 is visible in FIG. 2, likewise promote the emission of the light reflected by them from the unit with few reflections, without the screening effect of the unit being substantially impaired in the critical planes (CO−C180 and C90−C270).

FIG. 2 shows five light beams 1, 2, 3, 4 and 5, which illustrate light reflections according to the above description.

As has already been mentioned, the special construction of the base-side cover the louvre vanes RL from a flat central part MS and pyramid-shaped hoods H, as represented in FIG. 2, is especially advantageous in allowing the louvre vanes RL, together with the hood-shaped cover, to be formed in each case from a single sheet-metal part.

Figure 3:
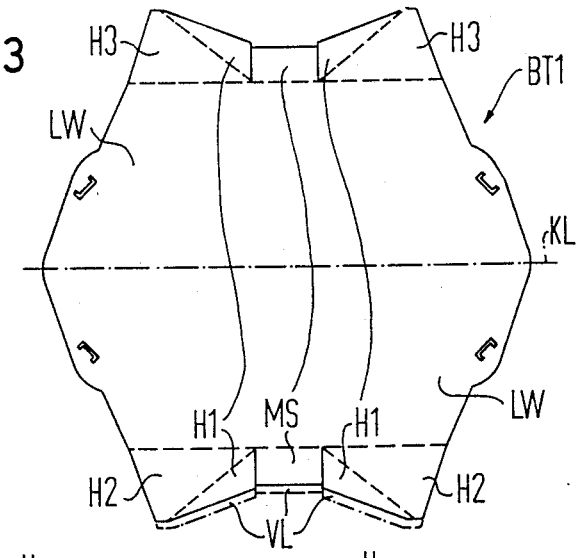
FIG. 3 shows a first embodiment of a sheet-metal part for forming a louvre vane, including a hood-shaped cover.

A first embodiment for such a sheet metal part BT1 is shown in FIG. 3. It is asymmetrical in shape about the ridge KL forming the peak of the double-parabola-shaped cross-section of the louvre vane RL, and at the free ends of the two vane walls LW it has in each case three sheet-metal sections, from which the flat central part MS is formed from the central sheet-metal section, and the hoods H with the upper side H1 and the slant sides H2 and H3 are formed from in each case two sheet-metal sections at opposite rims.

Figure 4:
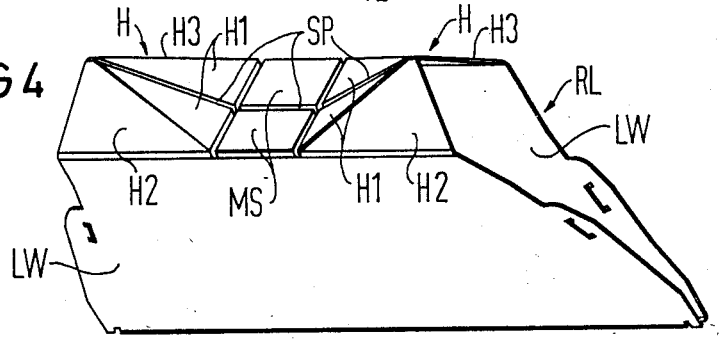
FIG. 4 is a perspective view of the louvre vane formed from the sheet-metal part according to FIG. 3, with a hood-shaped cover.

Together with its cover on the hood side, which is represented in perspective in FIG. 4, the louvre vane RL formed from the sheet-metal part BT1 according to FIG. 3 shows that the joint running parallel to the ridge KL is widened into a narrow groove SP in the cover of the hood side. Because the ends of the louvre vanes RL are flexibly anchored in correspondingly formed grooves in the longitudinal mirrors LS according to FIG. 2, this groove SP allows the vane walls LW to be moved elastically against one another at their base-side ends to such an extent that their rim-side anchoring in the abovementioned grooves of the longitudinal mirrors LS can be effected easily and without any risk of deformation.

The narrow groove SP causes a slight increase in the light losses, undesirable in themselves, which are caused by the louvre vanes RL.

The groove may be dispensed with if there is a slight overlap at the location of the joint between the two sheet-metal sections forming the central part MS, on the one hand, and the sheet-metal sections forming the upper side H1, on the other hand. As FIG. 3 shows, this can be achieved, for example, by providing the three sheet-metal sections adjacent to a vane wall LW on one side with an extension VL, as indicated with a dashed and dotted line. Of course, this extension VL can also be distributed on the three sheet-metal sections on the two opposite sides of the sheet-metal part BT1, so that its contour is once again symmetrical in relation to the ridge KL.

Figure 5:
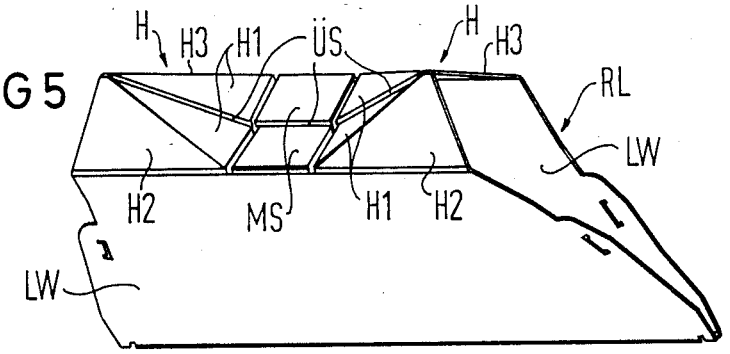
FIG. 5 is a perspective view of the louvre vane formed from a variation of the sheet-metal part according to FIG. 3, with a hood-shaped cover.

The louvre vane RL formed from the sheet-metal part BT1 with the desired extension VL according to FIG. 3 is represented in perspective in FIG. 5. The overlapping joint running parallel to the ridge KL is indicated in the FIG. with US.

Figure 6:
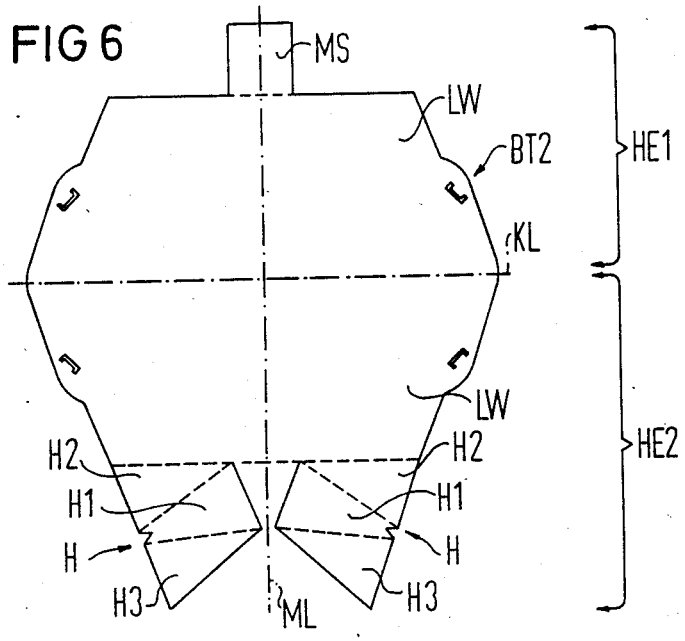
FIG. 6 shows a second embodiment of a sheet-metal part for forming a louvre vane, including a hood-shaped cover.

The groove can also be dispensed with if the contour of the sheet-metal section that is to be formed into the louvre vane RL with a hood-shaped cover, as is shown by the sheet-metal part BT2 according to FIG. 6, is asymmetrical in relation to the centre line ML, which is aligned perpendicular to the ridge KL forming the peak of the double-parabola-shaped cross-section. With reference to the ridge KL dividing the sheet-metal part BT2 into two halves HE1 and HE2, the sheet-metal sections provided for forming the two pyramid-shaped hoods H are allocated to the half HE2 while the sheet-metal section provided for the central part MS of the cover is allocated to the other half HE1.

Figure 7:
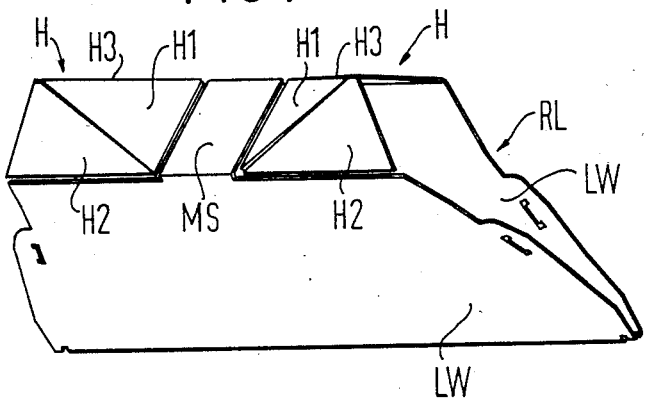
FIG. 7 is a perspective view of a louvre vane formed from a sheet-metal part according to FIG. 6, including a hood-shaped cover.

Here, as shown in perspective in FIG. 7 by the louvre vane RL formed from such a sheet-metal part BT2 according to FIG. 6, the joint between the free end of the flat central parts MS and the back vane wall LW, on the one hand, and between the slant sides H2 of the pyramid-shaped hoods H and the front vane wall LW, on the other hand, is diplaced into the transition with the van wall LW, This joint causes no light losses.

Moreover, with this embodiment it is possible for the two vane walls LW to be sprund against ont another along practically the entire width of the base of the double-parabola-shaped cross-section.

Mirror lighting units of the type described can be used as add-on and built-in light fitting for ceilings and as pendent light fitting for office accommodation where, regard to video workstations for example, demands are placed on the distribution of light.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A mirror lighting unit for a rod-shaped lamp, especially a fluorescent tube, having longitudinal mirrors extending on both sides parallel to the lamp, and louvre vanes arranged transverse thereto underneath the lamp and adjusted relative to the lamp with a base of their double-parabola-shaped cross-section, wherein all along their length the louvre vanes have a hood-shaped cover with reflecting surfaces on the base side of their cross-section, and with this line of intersection of the cover with a plane extending perpendicular to the longitudinal axis of the lamp has a concave curvature symmetrical in relation to the longitudinal axis of the lamp, comprising for simple manufacture of the louvre vanes, including their hood-shaped cover, from in each case one shapeable sheet-metal part the concave curvature of the line of intersection of the hood-shaped cover being approximated with a flat central part, which merges on both sides into a four-sided pyramid-shaped hood open towards the adjacent longitudinal mirror, and an angle of pitch ($\epsilon$) of upper sides of the pyramid-shaped hoods, which continue the flat central part on opposite sides, being dimensioned so as to approximate the resultant course of the line of intersection to a parabola.

2. The mirror lighting unit according to claim 1, wherein the sheet-metal part, from which the louvre vane can be formed together with the hood-shaped cover, has two identical sheet metal sections with a common ridge, which represent vane walls, to which are joined on sides opposite their common ridge, further sheet-metal sections, which serve to shape the central part and the hoods adjoining the central part on both sides and consisting in each case of the upper side and two slant sides.

3. The mirror lighting unit according to claim 1, wherein the contour of the sheet-metal part, from which the louvre vane with hood-shaped cover can be shaped, is symmetrical to a common ridge forming the peak of a double-parabola-shaped cross-section of the louvre vane.

4. The mirror lighting unit according to claim 1, wherein the sheet-metal part, of further sheet-metal sections adjoining the vane walls at the sides opposite their common ridge the sheet-metal section representing the central part borders on one vane wall and the sheet-metal parts providing the hoods, in each case, one upperside and two slant sides, border on the other vane wall.

5. A mirror lighting unit for a rod-shaped lamp, especially a fluorescent tube, having longitudinal mirrors extending on both sides parallel to the lamp, and louvre vanes arranged transverse thereto underneath the lamp and adjusted relative to the lamp with a base of their double-parabola-shaped cross-section, wherein all along their length the louvre vanes have a hood-shaped cover with reflecting surfaces on the base side of their cross-section, and with this line of intersection of the cover with a plane extending perpendicular to the longitudinal axis of the lamp has a concave curvature symmetrical in relation to the longitudinal axis of the lamp, comprising for simple manufacture of the louvre vanes, including their hood-shaped cover, from in each case one shapeable sheet-metal part the concave curvature of the line of intersection of the hood-shaped cover being approximated with a flat central part, which merges on both sides into a four-sided pyramid-shaped hood open towards the adjacent longitudinal mirror, and an angle of pitch (? ) of upper sides of the pyramid-shaped hoods, which continue the flat central part on opposite sides, being dimensioned so as to approximate the resultant course of the line of intersection to a parabola, a joint produced when the sheet-metal part is shaped, and present in the hood-shaped cover along the louvre vane, taking the form of a narrow groove, the width of which is dimensioned so as to provide an ample, base-side compression spring excursion of vane walls which serves to anchor the louvre vane flexibly in the longitudinal mirrors.

6. A mirror lighting unit for a rod-shaped lamp, especially a fluorescent tube, having longitudinal mirrors extending on both sides parallel to the lamp, and louvre vanes arranged transverse thereto underneath the lamp and adjusted relative to the lamp with a base of their double-parabola-shaped cross-section, wherein all along their length the louvre vanes have a hood-shaped cover with reflecting surfaces on the base side of their cross-section, and with this line of intersection of the cover with a plane extending perpendicular to the longitudinal axis of the lamp has a concave curvature symmetrical in relation to the longitudinal axis of the lamp, comprising for simple manufacture of the louvre vanes, including their hood-shaped cover, from in each case one shapeable sheet-metal part the concave curvature of the line of intersection of the hood-shaped cover being approximated with a flat central part, which merges on both sides into a four-sided pyramid-shaped hood open towards the adjacent longitudinal mirror, and an angle of pitch ($\epsilon$) of upper sides of the pyramid-shaped hoods, which continue the flat central part on opposite sides, being dimensioned so as to approximate the resultant course of the lien of intersection to a parabola, a joint produced when the sheet-metal part is shaped, and present in the hood-shaped cover along the louvre vane, taking the form of an overlapping joint.

* * * * *